US005235894A

United States Patent [19]

Nitschké et al.

[11] Patent Number: 5,235,894

[45] Date of Patent: Aug. 17, 1993

[54] FIRING DEVICE

[75] Inventors: Félix Nitschké, München; Thomas Sikora; Hans Leis, both of Neubiberg, all of Fed. Rep. of Germany

[73] Assignee: Messerschmitt-Bölkow-Blohm GmbH, München, Fed. Rep. of Germany

[21] Appl. No.: 839,952

[22] Filed: Feb. 21, 1992

[30] Foreign Application Priority Data

Feb. 22, 1991 [DE] Fed. Rep. of Germany ..... 4105589

[51] Int. Cl.[5] ..... F41B 6/00

[52] U.S. Cl. ..... 89/8; 124/3

[58] Field of Search ..... 89/7, 8; 124/3

[56] References Cited

U.S. PATENT DOCUMENTS

| | | | |
|---|---|---|---|
| 2,899,864 | 8/1959 | Bloxsom | 89/7 |
| 3,267,720 | 8/1966 | Escallier et al. | 89/8 |
| 4,895,062 | 1/1990 | Chryssomallis et al. | 89/7 |
| 4,957,035 | 9/1990 | Eskam et al. | 89/8 |
| 4,974,487 | 12/1990 | Goldstein et al. | 89/7 |

FOREIGN PATENT DOCUMENTS

3814332A1 11/1989 Fed. Rep. of Germany .

3816300A1 11/1989 Fed. Rep. of Germany .

3910566C2 10/1990 Fed. Rep. of Germany .

OTHER PUBLICATIONS

Grob, Bernard, Basic Electronics, Fifth Edition, 1984, p. 212.

*Primary Examiner*—Stephen C. Bentley

*Attorney, Agent, or Firm*—McGlew and Tuttle

[57] ABSTRACT

A device for firing projectiles (9) through an electrically heated plasma including a combustion chamber (12) which is provided on the breech side and the muzzle side with an electrode each, between which an arc generating plasma burns. A cartridge (18), which contains a material that decomposes into a low-molecular-weight gas under the effect of the arc, can be introduced into the combustion chamber (12). A current conductor, which connects a breech-side electrode (10) to the muzzle-side electrode (7) extending annularly around the muzzle-side end of the cartridge (18), is arranged in the longitudinal axis of the cartridge (18). The current conductor (20) consists of a plurality of strands (21) which extend radially to the outside from the longitudinal axis toward the annular electrode (7) at least at the muzzle-size end of the cartridge (18).

7 Claims, 1 Drawing Sheet

FIRING DEVICE

FIELD OF THE INVENTION

The present invention pertains to a device for firing projectiles by means of an electrically heated plasma including using a combustion chamber with a muzzle-side electrode and a breech-side electrode, between which an arc generating the plasma burns, a cartridge is introduced into the combustion chamber wherein the cartridge contains a material that decomposes into a low-molecular-weight gas under the effect of the arc and contains a current conductor that connects the two electrodes.

BACKGROUND OF THE INVENTION

Such a device has been known from German Offenlegungsschrift No. DE-OS 38,14,332. The cartridge consists of an electrically nonconductive sleeve which contains the material, consisting of a liquid or powder, that decomposes into a low-molecular-weight gas, and which contains the projectile, which also forms the muzzle-side electrode. To achieve this, the projectile is connected via a wire to a contact at the muzzle of the firing tube and has a cup-shaped design in order to gather the wire during firing. As a result, the projectile has an aerodynamically highly unfavorable shape. Handling is also made difficult by the fact that the wire has to be fixed and contacted at the tube muzzle. Furthermore, only a relatively thin wire, which consequently has a relatively high electrical resistance, can be gathered with the cup-shaped projectile.

According to West German Offenlegungsschrift No. DE-OS 38,16,300, one end of the current conductor, which extends through the bottom of the cartridge, strikes the muzzle-side end face of the combustion chamber housing. This type of contacting also leads to a high electrical resistance.

SUMMARY AND OBJECTS OF THE INVENTION

It is an object of the present invention to provide a device for firing projectiles through an electrically heated plasma by providing a combustion chamber with a muzzle-side electrode and a breech-side electrode, between which an arc generating the plasma burns, providing a cartridge that can be introduced into the combustion chamber wherein the cartridge contains a material that decomposes into a low-molecular-weight gas under the effect of the arc and contains a current conductor which has a simple design, is easy to handle, and guarantees low electrical resistance of the contact made with the current conductor.

According to the invention, a device for firing projectiles through an electrically heated plasma is provided comprising a combustion chamber with a muzzle-side electrode and a breech-side electrode. Between the two electrodes, an arc generating the plasma burns. A cartridge is provided that can be introduced into the combustion chamber. The cartridge contains a material that decomposes into a low-molecular-weight gas under the effect of the arc. The cartridge contains a current conductor, which runs along a longitudinal axis of the cartridge and connects the two electrodes. The muzzle-side electrode is arranged annularly around a muzzle-side end of the cartridge and the current conductor comprises a plurality of strands which extend at the muzzle-side end of the cartridge radially from the longitudinal axis to the annular electrode.

Since the current conductor consists of a plurality of strands or filaments which extend radially or in a star-shaped pattern to the outside toward the muzzle-side annular electrode at the muzzle-side end of the cartridge, a large number of contacts between the electrode and the current conductor are provided, which lead to a correspondingly low electrical contacting resistance.

The strands of the current conductor may also extend to the outside at the breech-side end of the cartridge in order to ensure a better contact with the breech-side electrode.

The individual strands of the current conductor may be formed from a metal wire. Since the current conductor is converted into a plasma, a metal with a low atomic weight, preferably aluminum or lithium, should be used.

However, a current conductor in which the individual strands consist of carbon fibers is particularly preferably used, because carbon fibers possess a relatively high sublimation temperature, above 3000° C. This means that current flows through the carbon fibers until this high sublimation temperature, i.e., a temperature near the plasma temperature, is reached. As a result, an arc or plasma canal is formed from the carbon fibers, and this ensures the decomposition of the material surrounding the plasma canal into a low-molecular-weight gas, from which more plasma will be formed. Carbon also has a low atomic weight, which is favorable for plasma formation.

For providing a better contact with the electrodes, the carbon fibers may be metallized, e.g., with a conductive paste.

To enlarge the contact surface between the muzzle-side annular electrode and the current conductor and consequently further reduce the electrical resistance, the individual strands, which extend to the outside in a star-shaped pattern from the longitudinal axis of the cartridge at the end face, may be bent at right angles, either toward the cartridge, i.e., toward the circumferential surface of the cartridge, or away from the cartridge, so that they extend from the cartridge in the forward direction toward the muzzle of the firing tube. Thus, the resistance can be reduced into the milliohm range.

The material which decomposes into a low-molecular-weight gas under the effect of the arc preferably contains a high percentage of hydrogen. It may be a liquid, e.g., a low-molecular-weight alcohol, such as propyl alcohol.

Low molecular or atomic weight of the gas into which the material decomposes under the effect of the arc is significant in order for the plasma not to absorb an excessively large amount of kinetic energy, which is extracted from the kinetic energy of the projectile.

Wax is a particularly preferred material. This means that the cartridge preferably has no sleeve, but is designed as a wax candle through which the current conductor extends like a wick. For example, polyethylene wax or paraffin wax may be used as the wax.

Due to the use of such a candle, the entire internal diameter of the combustion chamber can be filled with a material suitable for plasma formation. In addition, the wax burns off without leaving a residue, so that the combustion chamber is not contaminated.

Furthermore, it was observed when polyethylene powder was used that a large portion escapes through the muzzle on ignition without forming a plasma. This is also prevented from happening with the wax candle construction according to the present invention.

Another advantage of the wax candle construction is the fact that readily oxidizable metals with low atomic weights, such as lithium, may be used as current conductors, because they are protected from the oxidizing effect of the ambient air by being embedded in the wax.

In addition, wax is easy to process. Thus, the strands or carbon fibers can easily be pressed into the wax at the end face or end faces and, if desired, at the muzzle-side circumferential section of the candle.

The external diameter of the candle is preferably slightly smaller than the internal diameter of the combustion chamber, or a groove is provided on the side of the candle in order to enable air to escape from the combustion chamber when a candle is being introduced from the muzzle side. By pushing in the candle some more, the combustion chamber can be completely filled.

The candle has an external diameter adjusted to the internal diameter of the combustion chamber and is of rotationally symmetric design. However, it does not need to be cylindrical or a solid body. The candle may have recesses both on its outside and inside.

For example, it may have a conical internal recess expanding toward the muzzle, which is filled with, e.g., a material other than wax. It is thus possible to optimize the internal ballistics. If recesses are provided on the outside, i.e., the candle is in contact with the combustion chamber wall only over part of its length rather than over its entire length, only the position of the candle within the combustion chamber must be ensured, especially in view of contacting the electrodes with the current conductor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
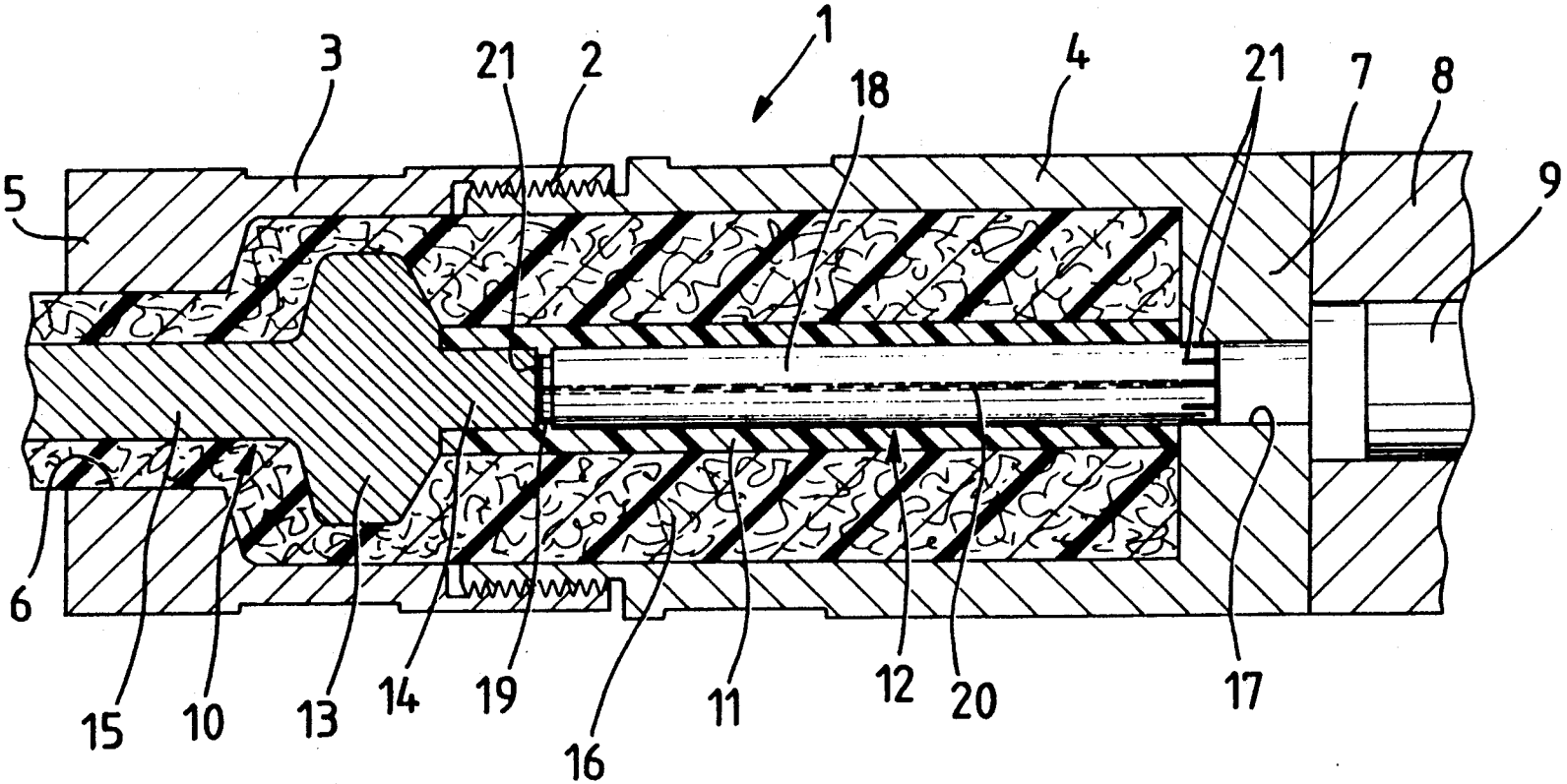
FIG. 1 is a longitudinal sectional view taken through the combustion chamber of the firing device according to the invention.

Referring to the drawings in particular, the firing device has a combustion chamber housing 1 made of, e.g., steel, which consists of the two parts 3 and 4 connected by, e.g., the screw connection 2.

The part 3 is closed by the bottom 5 which is provided with a coaxial opening 6. The bottom 7 of the part 4 is joined by the firing tube 8, in which the projectile 9 is located.

On the breech side, i.e., the side of the bottom 5 of the part 3, an electrode 10 (e.g., cathode) is arranged in the housing 1, and so is a sleeve 11, which surrounds the combustion chamber 12.

The electrode 10 is made of, e.g., steel, tungsten or a copper/tungsten alloy or another high-melting metal or metal alloy. The sleeve 11 consists of, e.g., a relatively heat-resistant plastic, such as high-molecular-weight polyethylene.

The electrode 10 has a mushroom-shaped thickening 13, from which a pin 14 extends into the sleeve 11, while another pin 15 on the other side of the thickening 13 extends through the opening 6 of the bottom 5 to the outside in order to be connected to a power source, not shown. The space between the cylindrical inner wall of the housing 1 and the opening 6 in the bottom 5 of the housing part 3 and between the coaxially arranged electrode 10 and the coaxially arranged sleeve 11 is filled with an electrical insulation 16, e.g., a glass fiber-reinforced plastic.

The bottom 7 of the housing part 4 has a coaxial hole 17, whose diameter corresponds to the internal diameter of the sleeve 11. However, the internal diameter of the sleeve 11 or the hole 17 is markedly smaller than the internal diameter of the firing tube 8, i.e., the caliber of the projectile 9.

The bottom 7, which forms the muzzle-side annular electrode (e.g., anode) of the firing device, can be connected to the other pole of the above-mentioned power source, e.g., by a lead that is connected to the housing 1.

A cartridge 18, which is introduced via the firing tube 8 and the hole 17 in the bottom 7 of the housing part 4, is arranged in the sleeve 11 or the combustion chamber 12. The cartridge 18 is designed as a wax candle structure, its circumferential surface is in tight contact with the circumferential wall of the sleeve 11, and extends from one of its ends, which is tapered and is inserted through an inner ring 19 of the sleeve 11, from one electrode 10 into the hole 17 in the bottom 7 of the housing part 4, i.e., into the other annular electrode.

A current conductor 20, which consists of a plurality of strands, e.g., a plurality of carbon fibers 21, is arranged in the core or the longitudinal axis of the cartridge or the wax candle 18.

Figure 2:
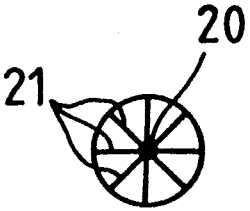
FIG. 2 is a top view of an end face of the cartridge according to the invention.

At the end face of the cartridge 18 facing the firing tube 8, i.e., the muzzle-side end face, the strands or carbon fibers 21 extend radially or in a star-shaped pattern to the outside from the longitudinal axis of the cartridge (FIG. 2) and are then bent over at right angles onto the outer circumferential surface of the cartridge 18. Thus, a relatively large contact surface is obtained between the current conductor 20 or the carbon fibers 21, of which the current conductor 20 consists, and the muzzle-side annular electrode formed by the bottom 7 of the housing part 4.

With its breech-side end face, the cartridge 18 is in contact with the end face of the electrode 10, wherein the carbon fibers 21 extend radially or in a star-shaped pattern to the outside at this end as well in order to obtain the largest contact surface possible.

While a specific embodiment of the invention has been shown and described in detail to illustrate the application of the principles of the invention, it will be understood that the invention may be embodied otherwise without departing from such principles.

What is claimed is:

1. A device for firing projectiles through an electrically heated plasma, comprising: a combustion chamber with a muzzle-side electrode and a breech-side electrode, an arc generating plasma burning between said muzzle-side electrode and said breech-side electrode; a cartridge that may be introduced into said combustion chamber, said cartridge including a material that decomposes into a low-molecular-weight gas under the effect of the arc, said cartridge containing a current conductor, running along the longitudinal axis, said current conductor connecting said muzzle-side electrode and said breech-side electrode, said muzzle-side electrode being arranged annularly around a muzzle-side end of said cartridge and said current conductor including a plurality of strands which extend at said muzzle-side end of said cartridge radially from said longitudinal axis to said annular electrode, said strands of said current conductor additionally being extended radially to an outside from said longitudinal axis on a breech-side end of said cartridge.

2. A device according to claim 1, wherein said strands extending radially to said annular electrode bend at right angles at their end.

3. A device according to claim 1, wherein individual strands of said current conductor are formed of carbon fibers.

4. A device according to claim 1, wherein said cartridge is formed of wax providing a wax candle type structure.

5. A device for firing projectiles through an electrically heated plasma, comprising: a combustion chamber with a muzzle-side electrode and a breech-side electrode, an arc generating plasma burning between said muzzle-side electrode and said breech-side electrode; a cartridge that may be introduced into said combustion chamber, said cartridge including a material that decomposes into a low-molecular-weight gas under the effect of the arc, said cartridge containing a current conductor, running along the longitudinal axis, said current conductor connecting said muzzle-side electrode and said breech-side electrode, said muzzle-side electrode being arranged annularly around a muzzle-side end of the cartridge and said current conductor including a plurality of strands which extend at said muzzle-side end of said cartridge radially from said longitudinal axis to the annular electrode, said strands of said current conductor additionally bending at right angles onto an outer circumferential surface of said cartridge.

6. A device for firing projectiles through an electrically heated plasma, comprising: a combustion chamber with a muzzle-side electrode and a breech-side electrode, an arc generating plasma burning between said muzzle-side electrode and said breech-side electrode; a solid cartridge that may be introduced into said combustion chamber through said muzzle side, said cartridge being formed of a material that decomposes into a low-molecular-weight gas under the effect of the arc, said cartridge containing a current conductor, running along the longitudinal axis, said current conductor connecting said muzzle-side electrode and said breech-side electrode, said muzzle side electrode being arranged annularly around a muzzle-side end of the cartridge and said current conductor including a plurality of strands which extend at said muzzle-side end of said cartridge radially from said longitudinal axis to an outside of said cartridge in a star shaped pattern for contact with the annular electrode.

7. A device according to claim 6, wherein individual strands of said current conductor are formed of carbon fibers, and said cartridge is formed of wax providing a wax candle type structure.

* * * * *